US007215069B2

(12) United States Patent
Suzuki

(10) Patent No.: US 7,215,069 B2
(45) Date of Patent: May 8, 2007

(54) SPARK PLUG

(75) Inventor: Akira Suzuki, Aichi (JP)

(73) Assignee: NGK Spark Plug Co., Ltd. (JP)

( * ) Notice: Subject to any disclaimer, the term of this patent is extended or adjusted under 35 U.S.C. 154(b) by 51 days.

(21) Appl. No.: 11/220,738

(22) Filed: Sep. 7, 2005

(65) Prior Publication Data

US 2006/0066196 A1 Mar. 30, 2006

(30) Foreign Application Priority Data

Sep. 24, 2004 (JP) ..... 2004-278052

(51) Int. Cl.
*H01T 13/36* (2006.01)

(52) U.S. Cl. ..... 313/143

(58) Field of Classification Search ..... None
See application file for complete search history.

(56) References Cited

U.S. PATENT DOCUMENTS 6,407,487 B1 * 6/2002 Sugimoto ..... 313/141
6,632,381 B2 * 10/2003 Sugimoto ..... 264/12
2003/0117052 A1 6/2003 Yamaguchi et al. ..... 313/118

FOREIGN PATENT DOCUMENTS

| | | |
|---|---|---|
| EP | 1309052 | 5/2003 |
| JP | 61-93575 | 12/1986 |
| JP | 9045456 | 2/1997 |
| JP | 10073069 | 3/1998 |
| JP | 2002260817 | 9/2002 |

* cited by examiner

*Primary Examiner*—Ashok Patel
(74) *Attorney, Agent, or Firm*—Kusner & Jaffe

(57) ABSTRACT

A spark plug having a packing interposed between an insulating porcelain and a metallic shell, wherein Young's modulus G of the material forming the metallic shell 50 and Young's modulus F of the material forming the packing 80 satisfies the relation of $7.4\times10^{10}$ Pa is less than or equal to F is less than or equal to G minus $5\times10^{10}$ Pa.

5 Claims, 5 Drawing Sheets

SPARK PLUG

FIELD OF THE INVENTION

The present invention relates to a spark plug having an annular packing interposed between an insulating porcelain and a metallic shell.

BACKGROUND OF THE INVENTION

A spark plug is used in an internal-combustion engine for the purpose of ignition. A general spark plug is comprised of a metallic shell for holding an insulating porcelain in which a center electrode is inserted, and a ground electrode welded to the leading end of the metallic shell. A spark discharge gap is formed between the other end of the ground electrode and the opposite leading end of the center electrode. Spark discharge occurs between the center electrode and the ground electrode.

The metallic shell of the spark plug is fixed to the insulating porcelain by inserting the leading end of the insulating porcelain from its rear end side to the leading end side, and tightening the opening of the rear end side to the insulating porcelain side (inside the radial direction of metallic shell). An annular packing is interposed in the gap between the metallic shell and insulating porcelain. By firmly tightening the insulating porcelain and metallic shell, both sides of the packing are tightly fitted to the insulating porcelain and metallic shell so that air tightness is maintained. Carbon steel, such as SPCC (cold rolled steel) having a hardness nearly the same as that of the metallic shell made of ferrous material, may be used as the material of such packing. Iron or copper, both excellent in heat resistance, may also be used (see, for example, Japanese Patent Application Laid-Open No. Hei 10-73069).

Recently, an increase in the output, and a decrease in fuel consumption are demanded from automotive engines. As a result, a smaller diameter spark plug having a longer reach is requested from the viewpoint of degree of freedom in design of the engine. As the spark plug diameter becomes smaller and the reach, i.e., the length, becomes longer, the wall thickness of the metallic shell is reduced. As a result, the strength of the metallic shell itself is reduced, and it is necessary to reduce the strength of the tightening force. This leads to a reduction of residual stress accumulated in the packing from tightening, and it is difficult to maintain the air tightness. Accordingly, it is proposed to accumulate a larger residual force in the packing by allowing it to be tightened firmly by forming the metallic shell from a material of higher strength.

However, since the metallic shell is usually formed by cutting, i.e., machining, after its forming by forging, if the strength of the metallic shell is increased, forging or cutting is more difficult, and productivity may be lowered.

Japanese Patent Application Laid-Open No. Hei 10-73069 proposes forming the packing by using a material of lower strength than that of the metallic shell. However, unless an appropriate material is selected, the packing may not retain its annular shape when the residual stress generated by tightening is applied thereto, or air tightness may not be maintained, or the packing may not withstand the pressure of tightening and may be broken.

The present invention addresses these problems of the prior art, and provides a spark plug capable of maintaining air tightness by the packing interposed between the insulating porcelain and the metallic shell.

SUMMARY OF THE INVENTION

In accordance with one aspect of the present invention, there is provided a spark plug comprised of an axial center electrode for spark discharge at its own leading end, an insulating porcelain having an axial hole extending in the direction of the axial line of the center electrode, the center electrode being disposed inside of the axial hole, a metallic shell surrounding the insulating porcelain in the radial direction, and said metallic shell tightening and holding the outer circumference of the insulating porcelain with an outer step on the insulating porcelain fixed in an inner step on said metallic shell, and an annular packing interposed between the outer step of the insulating porcelain and the inner step of the metallic shell for fitting the two tightly, in which Young's modulus F (Pa) of the material of the packing and Young's modulus G (Pa) of the material of the metallic shell satisfy the relation of $7.4\times0.10^{10}\cdot(\text{Pa})=<F=<G-5\times10^{10}$ (Pa), and the tensile strength of the material of the packing is 400 MPa or more.

In accordance with another aspect of the present invention, there is provided a spark plug as described above which further comprises a tightening lid provided integrally with the metallic shell for tightening the outer circumference of the insulating porcelain, in which the following relation is established, $B\times H=<18090$ (N), where B ($mm^2$) is the sectional area at the position of smallest sectional area of the metallic shell orthogonal to the direction of the axial line from the step of the metallic shell to the tightening lid in the direction of the axial line of the insulating porcelain, and H (MPa) is the yield point of the material of the metallic shell at this position.

In accordance with yet another aspect of the present invention, there is provided a spark plug as described above in which the thickness of the packing is 0.1 mm or more.

In the spark plug of the first aspect of the invention, the relation of Young's modulus F of the material of the packing interposed between the inner step of the metallic shell and the outer step of the insulating porcelain and Young's modulus G of the material of the metallic shell is set in $7.4\times10^{10}$ (Pa)$=<F=<G-5\times10^{10}$ (Pa). Heretofore, when manufacturing, for example, a spark plug of small diameter, the wall thickness of the metallic shell is also reduced. As a result, the force of the portion tightened by tightening applied toward the leading end side of the spark plug after tightening, that is, residual stress, becomes smaller. A conventional packing of high Young's modulus is stiff, and when the residual stress becomes smaller, the contact between the packing and both the inner step of the metallic shell and the outer step of the insulating porcelain become insufficient. As a result, sufficient air tightness cannot be maintained. By contrast, in the spark plug of the first aspect of the invention, Young's modulus of the packing is lower than that of the metallic shell, and sufficient residual stress is obtained, and air tightness of metallic shell and insulating porcelain is maintained. However, if Young's modulus F of packing is too low, the packing cannot retain its shape by overcoming the residual stress, and air tightness may be broken partially. In the spark plug of the first aspect of the invention, since Young's modulus F of the packing is set at $7.4\times10^{10}$ Pa or more, such that deformation of the packing at the time of tightening can be prevented.

Further, while satisfying the same conditions, the tensile strength of the material of the packing is defined at 400 MPa or more. Accordingly, at both steps for holding the packing lowered in Young's modulus than that of the metallic shell, breakage due to tightening force can be prevented.

In the spark plug of the second aspect of the invention, in addition to the effects of the first aspect of the invention, for the spark plug using the metallic shell of which product of sectional area B at the position of smallest sectional area of the metallic shell orthogonal to the direction of the axial line from the step of the metallic shell to the tightening lid in the direction of the axial line of the insulating porcelain and yield point H of the material of the metallic shell at this position is 18090 N or less the packing of the spark plug in the first aspect of the invention is used. The location of the smallest sectional area of the metallic shell is the thinnest portion of the metallic shell of tubular shape, that is, the position most likely to receive effects of force applied to the metallic shell at the time of tightening. Hence, the metallic shell of which product of sectional area B and yield point H of the material at this position is 18090 N or less cannot apply large force to the tightening lid at the time of tightening, so that the residual stress of the tightening lid after tightening is small. However, a packing of the spark plug according to the invention is more effective because a sufficient residual stress can be obtained for maintaining the air tightness, in spite of small residual stress of the tightening lid after tightening.

In the spark plug of the third aspect of the invention, in addition to the effects of the first or second aspects of the invention, because the thickness of the packing is 0.1 mm or more, sufficient thickness for maintaining the necessary residual stress compression is obtained, and the air tightness of the metallic shell and insulating porcelain are enhanced. The specified thickness of the packing is measured after assembling the metallic shell and insulating porcelain, and is enough to satisfy the above conditions.

These and other advantages will become apparent from the following description of a preferred embodiment taken together with the accompanying drawings and the appended claims.

BRIEF DESCRIPTION OF THE DRAWINGS

The invention may take physical form in certain parts and arrangement of parts, a preferred embodiment of which will be described in detail in the specification and illustrated in the accompanying drawings which form a part hereof, and wherein.

DETAILED DESCRIPTION OF PREFERRED EMBODIMENT

Figure 1:
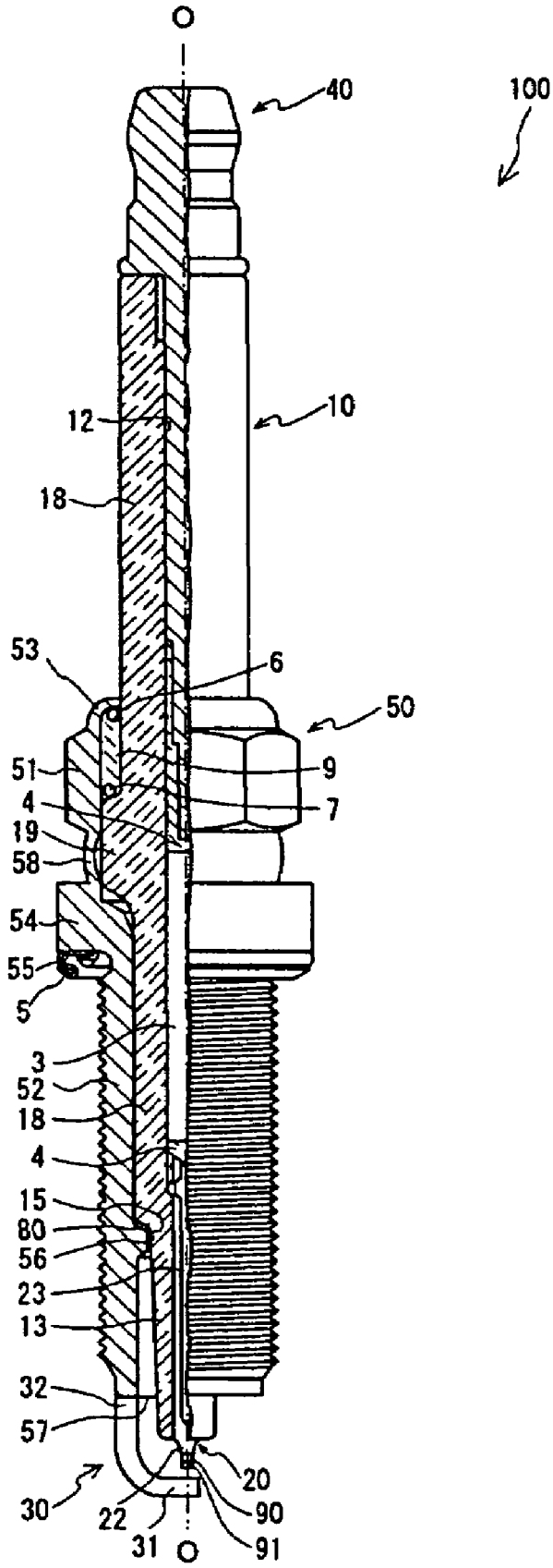
FIG. 1 is a partial sectional view of a spark plug 100.

Referring now to the drawings wherein the showings are for the purpose of illustrating the preferred embodiment of the invention only, and not for the purpose of limiting same, FIG. 1 shows a spark plug 100, illustrating an embodiment of the present invention. FIG. 1 is a partial sectional view of spark plug 100. In FIG. 1, the direction of an axial line O of the spark plug 100 is shown as the vertical direction. The lower side of spark plug 100 is indicated as the leading end of the spark plug 100, and the upper side is explained as a rear end.

As shown in FIG. 1, the spark plug 100 is comprised of an insulating porcelain 10 forming an insulator, a metallic shell 50 for holding this insulating porcelain 10, a center electrode 20 held in the insulating porcelain 10 in the direction of the axial line O, a ground electrode 30 having its base 32 welded to a leading end side 57 of the metallic shell 50, with one side of the leading end 31 opposite to the leading end 22 of the center electrode 20, and a terminal 40 provided at the rear end of the insulating porcelain 10.

The insulating porcelain 10 forms the insulator of the spark plug 100. As known well, the insulating porcelain 10 is formed by sintering alumina or the like. Insulating porcelain 10 has a tubular portion 18 forming an axial hole 12 that extends in the direction of the axial line O around the shaft. Nearly in the center of the tubular portion 18 of the insulating porcelain 10, a flange portion 19 is formed. Flange portion 19 expands wider than the tubular portion 18. At the leading end of the tubular portion 18 (the lower side in FIG. 1), outside diameter of tubular portion 18 is reduced, and a leg portion 13 is provided to be exposed in a combustion chamber of an internal combustion engine (not shown). A step portion 15 is formed in the insulating porcelain 10 between the leg portion 13 and the tubular portion 18.

The center electrode 20 is formed of Inconel (registered tradename) 600 or 601, or other nickel alloy, and a metal core 23 of copper or the like that is excellent at heat conductivity is contained inside. The leading end 22 of the center electrode 20 protrudes from the leading end face of the insulating porcelain 10 and is formed to be smaller in diameter toward the leading end. At the leading end face of the leading end 22, a columnar electrode chip 90 is welded so that the columnar axis may coincide with the axial line of the center electrode 20. At the leading end of the electrode chip 90, a chip 91 of noble metal is bonded so as to enhance spark consumption resistance. The center electrode 20 is electrically connected to an upward terminal 40 by way of a seal body 4 and ceramic resistance 3 provided inside the axial hole 12. A high voltage cable (not shown) is connected to the terminal 40 by way of a plug gap (not shown), and a high voltage is applied.

The ground electrode 30 shall now be described. The ground electrode 30 is composed of a metal of high corrosion resistance, for example, Inconel (registered tradename) 600 or 601, or other nickel alloy. The ground electrode 30 has substantially a rectangular shape in its cross section in the longitudinal direction. Ground electrode 30 has a base 32 that is welded and bonded to the leading end face 57 of the metallic shell 50. The leading end side 31 of the ground electrode 30 is bent so that its one side may be opposite to the leading end 22 of the center electrode 20.

The metallic shell 50 shall now be described. The metallic shell 50 is a cylindrical metal piece for fixing the spark plug 100 to the engine head of an internal combustion engine (not shown), and surrounds and holds the insulating porcelain 10. The metallic shell 50 is formed of a ferrous material, and includes a tool engaging portion 51 for engaging with a spark plug wrench (not shown), and a male threaded portion 52 for engaging with the engine head provided in the upper part of internal combustion engines (not shown). The tightening portion 53 is provided at the rear end side from the tool engaging portion 51. This tightening portion 53 corresponds to the tightening lid of the invention.

By tightening the tightening portion 53, the step portion 15 of the insulating porcelain 10 is supported on the step portion 56 of the metallic shell formed in the metallic shell 50 by way of a packing 80 described below, and the metallic shell 50 and insulating porcelain 10 are integrally formed. By tightening, step portion 15 and step portion 56 are held airtight. Annular ring members 6, 7 are interposed between the metallic shell 50 and insulating porcelain 10, and further the gap of the two ring members 6, 7 is filled up with powder of talc 9, in order to close perfectly to prevent escape of combustion gas. In this respect, the metallic shell 50 holds the insulating porcelain 10 by way of the packing 80, the ring members 6, 7, and talc 9. A flange 54 is formed between the tool engaging portion 51 of the metallic shell 50 and the male threaded portion 52, and a gasket 5 is fitted near the rear end side of the male threaded portion 52, that is, at the seat portion 55 of the flange 54.

Figure 2:
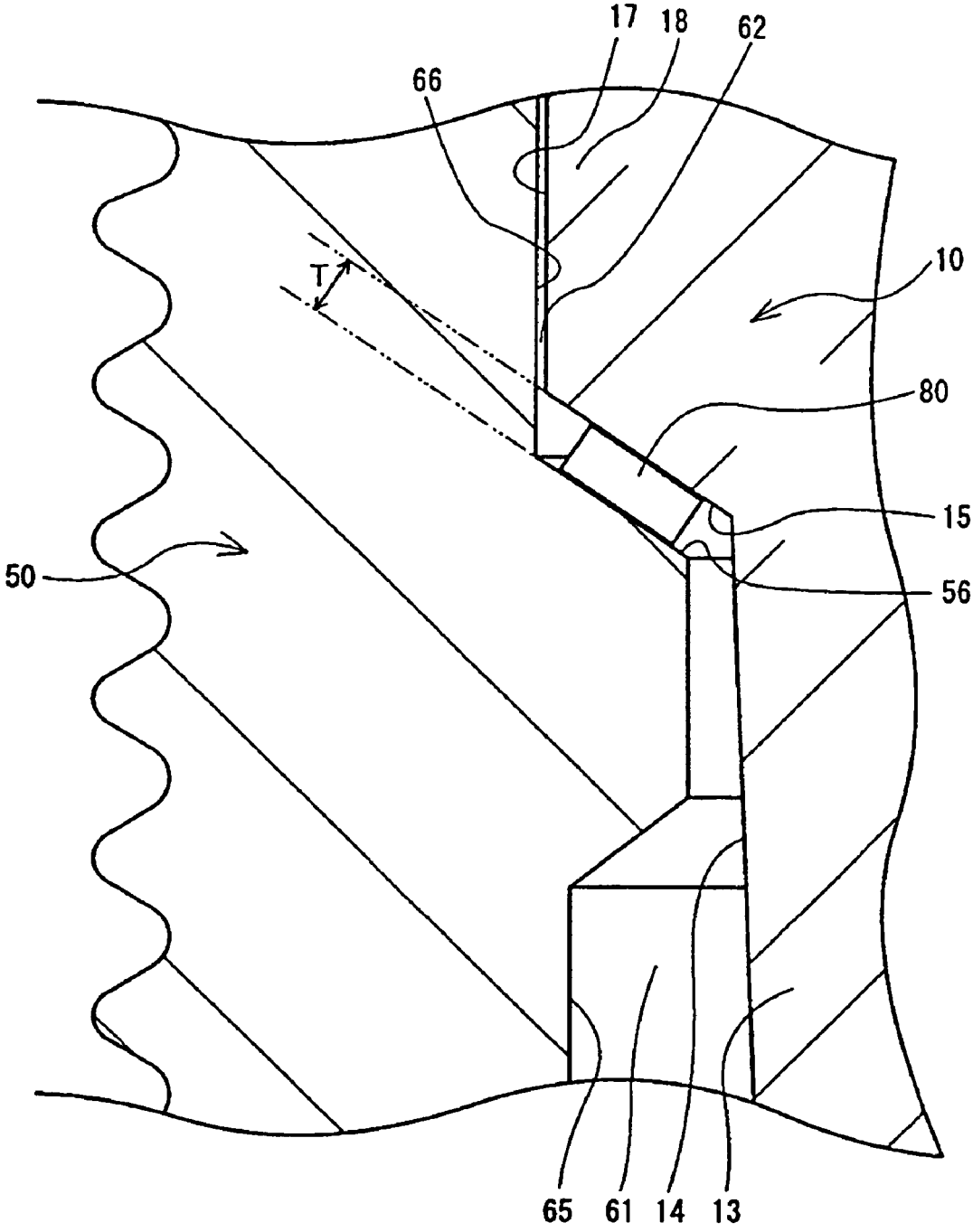
FIG. 2 is a magnified sectional view of essential parts near packing 80.
Figure 3:
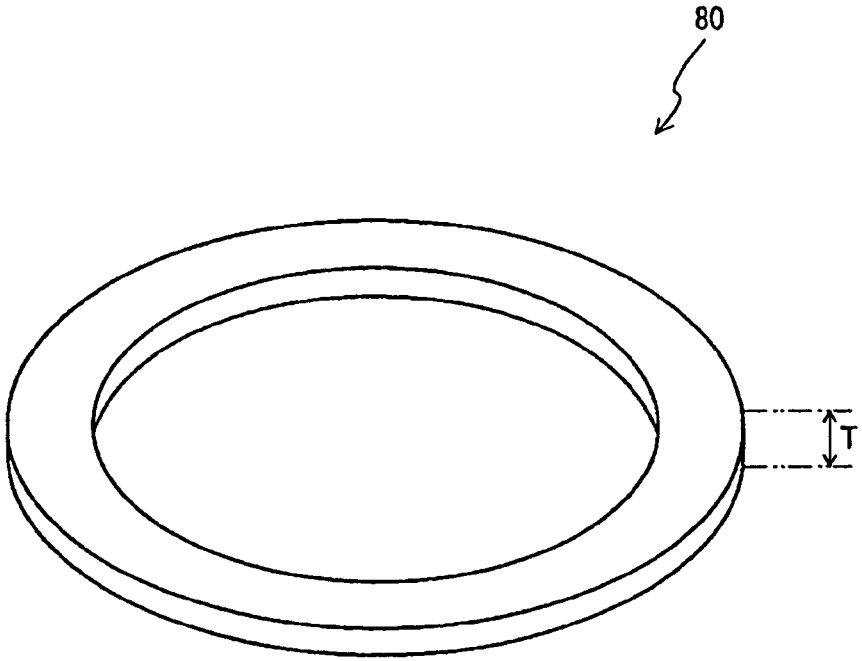
FIG. 3 is a perspective view showing the configuration of a packing 80.

Referring now to FIG. 1 to FIG. 3, the packing 80 is explained. FIG. 2 is an enlarged, sectional view of essential parts in the vicinity of the packing 80. FIG. 3 is a perspective view of the packing 80.

As shown in FIG. 1 and FIG. 2, the step portion 56 of the metallic shell is formed on the inner circumference of the metallic shell 50, that is, opposite to the outer circumference of the insulating porcelain 10. Further, the step portion 15 of the insulating porcelain 10 is formed on the outer circumference of the insulating porcelain 10, opposite to the step portion 56. The insulating porcelain 10, when tightened by the metallic shell 50, is pressed toward the leading end (lower side in FIG. 1) of the spark plug 100. The pressing direction is a mutually approaching direction of opposite to the step portion 56 and step portion 15, and the packing 80 is held between step portions 56 and 15. Packing 80 is disposed so that the combustion air in gap 61, that is defined between an outer circumference 14 of the leg portion 13 of the insulating porcelain 10 and an inner circumference 65 of the metallic shell 50, may not flow into a gap 62, that is defined between an inner circumference 66 of the metallic shell 50 and an outer circumference 17 of the tubular portion 18 of the insulating porcelain 10.

As shown in FIG. 3, the packing 80 is an annular sheet packing, and it is formed in this embodiment from a blank sheet of a phosphor bronze (Cu-8Sn-0.2P). As mentioned above, the metallic shell 50 in the embodiment is formed of ferrous material, and its Young's modulus is about $21\times10^{10}$ Pa. Herein, the lower the Young's modulus of the packing 80, the stronger the contact of the two if the tightening force is lower between the step portion 56 of the metallic shell 50 and the step portion 15 of the insulating porcelain 10. That is, if the residual stress after tightening the tightening portion 53 is lower, the packing 80 is firmly fitted to both step portions 56 and 15, so that the air tightness is maintained sufficiently by the packing 80. In this embodiment, therefore, the packing 80 is formed by using phosphor bronze of which Young's modulus is about $11\times10^{10}$ Pa. At this time, supposing Young's modulus of the material of the metallic shell 50 to be G (Pa), and Young's modulus of the material of the packing 80 to be F (Pa), it is desired to have the relation $7.4\times10^{10}$ (Pa)=<F=<G−$5\times10^{10}$ (Pa), as proved in Example 1 explained later.

If Young's modulus F of the packing 80 is less than $7.4\times10^{10}$ Pa, the packing 80 may not retain its shape under the force applied to the packing 80 by tightening, and the air tightness may not be maintained. Further, when the packing 80 is deformed at the time of tightening, an excessive force may be applied to the insulating porcelain 10, and the insulating porcelain 10 may be pushed and broken. If Young's modulus F of the packing 80 is greater than the balance of Young's modulus G of the metallic shell 50 minus $5\times10^{10}$ Pa, the residual force accumulated by tightening becomes smaller, and it is difficult to maintain tight contact between packing 80 and the metallic shell 50 and the insulating porcelain 10, and thus difficult to maintain the air tightness between gaps 61 and 62.

Thus, when Young's modulus of the packing 80 is set lower than that of the metallic shell 50, the packing 80 may be broken apart unless the tensile strength is sufficient, when the packing 80 held between the step portion 56 of the metallic shell 50 and the step portion 15 of the insulating porcelain 10, to withstand a pressing force by tightening. As tested in Example 2 described below, it is found satisfactory when the packing 80 is formed by using a material of which tensile strength is 400 MPa or more.

If the thickness (thickness T in FIG. 2 and FIG. 3) of the packing 80 is not sufficient, the desired effect of maintaining air tightness between gaps 61 and 62 may not be obtained, and in this embodiment, therefore, the thickness of the packing 80 after assembling into the spark plug 100 is defined to be 0.1 mm or more. If the thickness of the packing 80 is less than 0.1 mm, sufficient distance is not obtained for accumulating the residual stress and it is hard to maintain the air tightness, as confirmed in Example 4 given below.

The spark plug 100 using the packing 80 fabricated as described above is small in size, and the wall thickness of the metallic shell 50 is thin as a result of reduction of size, and it is more effective when the rigidity of the metallic shell 50 is lower, as confirmed in Example 3 explained below. If the rigidity is low, firm tightening is not possible, and the contact tightness of the metallic shell 50, the insulating porcelain 10 and packing 80 is low. As a result, the air tightness of the members may not be maintained when receiving vibration or impact. When the rigidity is high, on the other hand, since firm tightening is possible, the contact tightness of the metallic shell 50, the insulating porcelain 10 and packing 80 is not lowered by vibration or impact.

Hence, in order to express the effects of using the packing 80 satisfying the above condition, it is desired that the metallic shell 50 should satisfy the relation of B×H=<18090 (N), where B ($mm^2$) is its sectional area at the position of smallest area of the axial section, and the positions from the step of the metallic shell to the tightening lid 53 in the direction of axial line O, and H (MPa) is the yield point of the material of the metallic shell 50 at this position. This is verified in Example 3 described below.

In the metallic shell 50 of the spark plug 100 of the disclosed embodiment, the position of smallest area of the axial line section is, specifically in FIG. 1, a buckling portion 58 located between the flange 54 and tool engaging portion 51, or the root part of the tightening portion 53 consecutive to the tool engaging portion 51. Of the tightening portion 53, the deformed portion curved by tightening is not included in the positions from the disposing position of the packing 80 in the metallic shell 50 in the direction of axial line O up to the tightening portion 53. The tightening portion 53 and buckling portion 58 are portions of lowest rigidity in the metallic shell 50 in the direction of axial line O. When a metallic shell 50 satisfies the above condition, a spark plug 100 that is small in diameter can be formed. Unlike spark plugs of large diameter, when a packing according to the present invention is used in a spark plug of small diameter, where it is difficult to increase the residual stress in the tightening portion 53 when tightening, the air tightness can be maintained more effectively.

Figure 4:
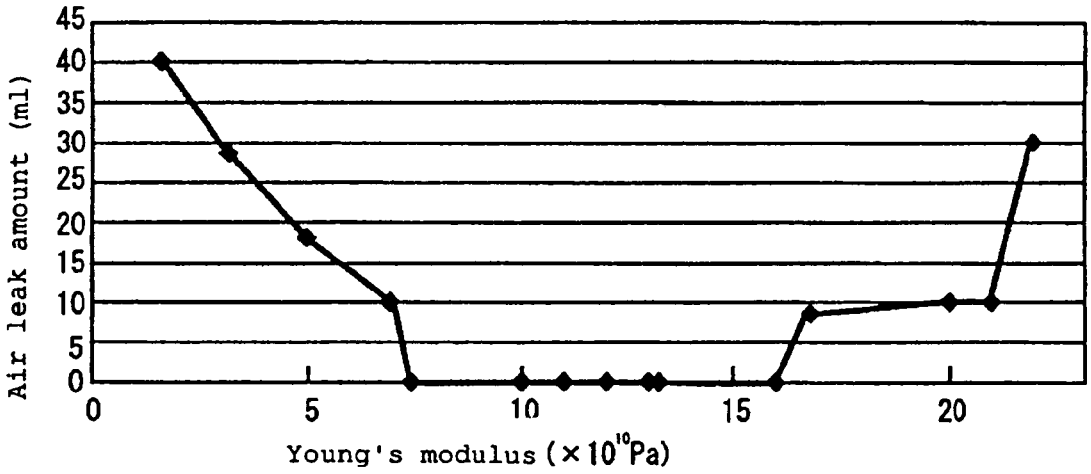
FIG. 4 is a graph showing results of evaluation test about relation between Young's modulus of the packing and air tightness.
Figure 5:
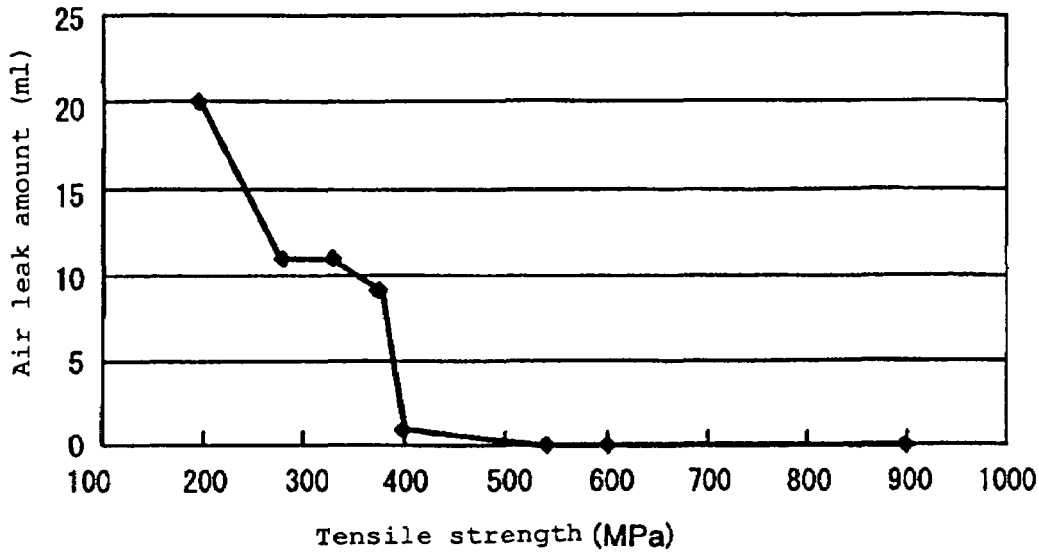
FIG. 5 is a graph showing results of evaluation test about relation between tensile strength of the packing and air tightness.
Figure 6:
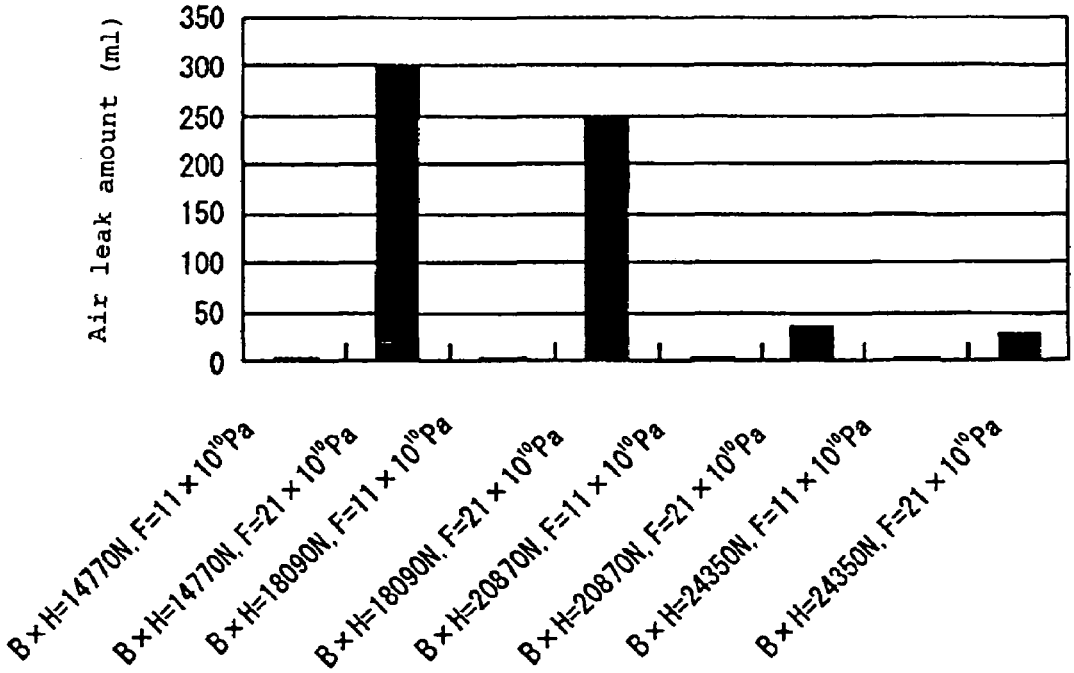
FIG. 6 is a graph showing results of evaluation test about relation between size of a metallic shell and Young's modulus of the packing.
Figure 7:
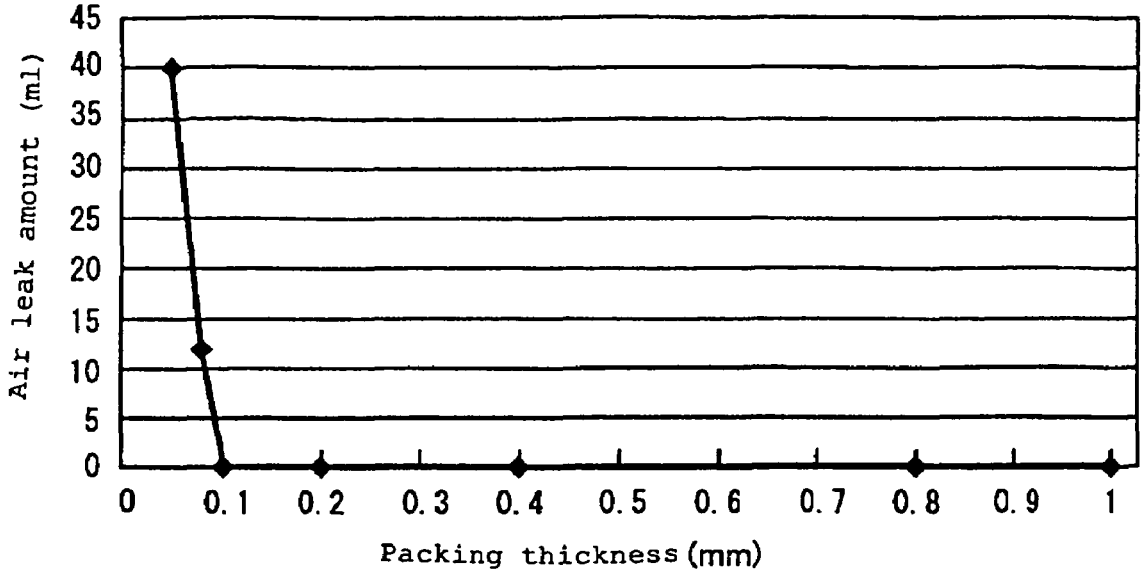
FIG. 7 is a graph showing results of evaluation test about relation between thickness of the packing and air tightness.

In the spark plug having such configuration, tests are conducted to evaluate the effects of the invention in Examples 1 to 4 below. Referring now to FIG. 4 to FIG. 7, Examples 1 to 4 are explained. FIG. 4 is a graph showing the results of the evaluation test about the relation between Young's modulus of the packing and air tightness. FIG. 5 is a graph showing the results of the evaluation test about the relation between the tensile strength of the packing and air tightness. FIG. 6 is a graph showing the results of the evaluation test about the relation between the size of the metallic shell and Young's modulus of the packing. FIG. 7 is a graph showing the results of the evaluation test about the relation between the thickness of the packing and air tightness.

In the evaluation tests of air tightness in Examples 1 to 4, in each test sample, the average amount of air leakage between the gap 61 at the leading end side of the packing 80 and the gap 62 at the rear end side is measured for one (1) minute. The air leakage amount is explained in the example of the spark plug 100 of the embodiment shown in FIGS. 1 and 2, in which an opening is provided to penetrate from the side of the flange 54 of the metallic shell 50 to the gap 62. Air is sent into the gap 61 from the leading end side of the spark plug 100 at an air pressure of 2 MPa. The escape (ml) of air per minute flowing out to the opening through the gap 62 between step portions 15 and 56 and packing 80 is measured by an air flow meter. At that time, the temperature is measured at the seat portion 55 of the metallic shell 50, and the temperature is adjusted to 25° C. by heating.

EXAMPLE 1

The relation between Young's modulus of the packing 80 and air tightness is evaluated. Using different materials so as to differ in Young's modulus F, fifteen types of packings are prepared and assembled in test samples, and air leaks from the spark plugs are measured. In each test sample, the metallic shell is manufactured using a material of which Young's modulus G is $21\times10^{10}$ Pa. The packings are manufactured to the same size, differing only in Young's modulus F, and at the same thickness of 0.3 mm.

As a result, in test samples assembling packings of which Young's modulus F is 22.00, 21.00, 20.00, 16.80, 16.00, 13.25, 13.00, 12.00, 11.00, 10.00, 7.40, 6.90, 4.99, 3.19, and 1.61($\times\mathbf{10}^{10}$ Pa), the air leak amount per minute is respectively 30, 10, 10, 8, 0, 0, 0, 0, 0, 0, 0, 10, 18, 29, and 40 (ml). The results are plotted in graph in FIG. 4, and it is confirmed that if Young's modulus F of the packing is between $7.4\times10^{10}$ Pa and $16\times10^{10}$ Pa, the air tightness is very high without allowing air leakage. That is, in the metallic shell of which Young's modulus F is at least $7.4\times10^{10}$ Pa or more, or Young's modulus is $21\times10^{10}$ Pa, by using a packing having a hardness difference so that Young's modulus F may be lower at least by $5\times10^{10}$ Pa or more, a sufficient air tightness is maintained.

EXAMPLE 2

The relation between the tensile strength of the packing and air tightness is evaluated. Using different materials so as to differ in tensile strength, eight types of packings are prepared and assembled in test samples, and air leaks are measured. In each test sample, the metallic shell is manufactured the same as in Example 1, using a material of which Young's modulus F is $21\times10^{10}$ Pa, and the thickness of packing is 0.3 mm.

As a result, in test samples assembling packings of which tensile strength is 195, 280, 330, 375, 400, 540, 600, and 900 (MPa), the air leakage amount per minute is respectively 20, 11, 11, 9, 1, 0, 0, and 0 (ml). The results are plotted in graph in FIG. 5, and it is confirmed that by using packings of which tensile strength is 400 MPa or more, spark plugs of very high air tightness and little air leakage can be manufactured.

EXAMPLE 3

The relation between the size of the metallic shell and Young's modulus of packing is evaluated. The size of the metallic shell is compared on the basis of the product of sectional area B at the position of smallest sectional area in the axial line section of the metallic shell and yield point H (stress limit of causing plastic deformation) of the material at this position. The smaller this value, the smaller the residual stress, and hence it is more difficult to tighten firmly. Same as in Examples 1 and 2, the metallic shell is manufactured using a material of which Young's modulus G is $21\times10^{10}$ Pa, and the thickness of the packing is 0.3 mm. Impact is applied to prepared test samples for 2 hours by a JIS type impact testing machine, and the air leakage amount is measured. Packings are manufactured from phosphor bronze of Young's modulus F of $11\times10^{10}$ Pa and ferrous material of $21\times10^{10}$ Pa, and assembled in metallic shells of each size.

As a result, in test samples assembling packings of ferrous material (Young's modulus F=$21\times10^{10}$ Pa) into the metallic shell of which product of sectional area B and yield point H of its metal material is 14770, 18090, 20870, and 24350 (N), the air leakage amount per minute is respectively 300, 250, 30, and 25 (ml). In test samples assembling packings of phosphor bronze (Young's modulus F=$11\times10^{10}$ Pa) into the metallic shell of which product of sectional area B and yield point H of metal material is 14770, 18090, 20870, and 24350 (N), the air leakage amount per minute is respectively 1, 1, 1, and 1 (ml). The results are plotted in graph in FIG. 6, and in the metallic shell of which B×H is 18090 (N) or less, difference in change of the air leakage amount due to reduction of Young's modulus F of packing is larger, and it is learned that air tightness can be securely enhanced by using the packing of the invention.

The metallic shell of which B×H is 18090 N corresponds generally to the hexagon or BI-HEX the diagonal size of 14 mm in the tool engaging portion. As known from Example 3, as compared with the metallic shell of which size is more than 14 mm, if smaller, firm tightening is more difficult, and hence the effect of enhancing the air tightness by the packing of the invention is more evident. More preferably, in the spark plug of the invention, a metallic shell having a hexagon or BI-HEX diagonal size of 12 mm (B×H is 14770 N) in the tool engaging portion should be used.

EXAMPLE 4

The relation between the thickness of the packing and air tightness is evaluated. Seven types of packings different in thickness are prepared and assembled in the spark plugs as test samples, and then the air leakage amount is measured. Same as in Example 1, the metallic shell of the test sample is manufactured using a material of which Young's modulus F is $21\times10^{10}$ Pa. Packings were manufactured from phosphor bronze of which Young's modulus is $11\times10^{10}$ Pa and tensile strength is 600 MPa.

As a result, in test samples assembling seven types of packings, the thickness of each packing measured after assembling is 0.05, 0.08, 0.1, 0.2, 0.4, 0.8, and 1.0 (mm). The air leakage amount per minute of each test sample is respectively 40, 12, 0, 0, 0, 0, and 0 (ml). The results are plotted in graph in FIG. 7, and it is learned that air does not leak when using a packing of which thickness is 0.1 mm or more, so a spark plug of extremely high air tightness can be manufactured.

The invention can be changed and modified in various forms. For example, the packing is preferably made of phosphor bronze (Cu-8Sn-0.2P), but any other material may be used as far as the aforementioned conditions are satisfied. In this respect, the packing may be also made, for example, of a copper alloy such as NB-109 of Dowa Mining Co., Ltd. (Cu-1.0Ni-0.9Sn-0.05P). Properties of the material explained in the embodiment are likely to be obtained in alloy mainly comprised of copper, and further by adding phosphorus, the tensile strength can be enhanced while keeping Young's modulus low.

The invention is applicable to spark plugs, temperature sensors, gas sensors, and other devices in which a ceramic base material such as insulating porcelain is integrally fixed to a metallic shell.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A spark plug comprising:

a center electrode for spark discharge at its own leading end having a central axis;

an insulating porcelain having an axial hole extending in a direction along said central axis of the center electrode, said porcelain holding the center electrode inside of the axial hole and having an outwardly projecting step portion;

a metallic shell surrounding the insulating porcelain in the radial direction, for tightening and holding the outer circumference of the insulating porcelain, said shell having an inwardly projecting step portion; and an annular packing interposed between the step portion of the insulating porcelain and the step portion of the metallic shell for sealing engagement therewith, said packing formed of a material having a Young's modulus F (Pa) and said metallic shell formed of a material having a Young's modulus G (Pa) wherein $7.4\times10^{10}$ (Pa) is less than or equal to F is less than or equal to G minus $5\times10^{10}$ (Pa), and the tensile strength of the material of the packing is 400 MPa or more.

2. The spark plug of claim 1, further comprising:

a tightening lid provided integrally with the metallic shell for tightening the outer circumference of the insulating porcelain, wherein the following relation is established:

B×H is less than or equal to 18090 (N) where B (mm2) is the sectional area at the position of smallest sectional area of the metallic shell orthogonal to the direction of central axis O from the step portion of the metallic shell to the tightening lid in the direction of central axis O of the insulating porcelain, and H (MPa) is the yield point of the material of the metallic shell at this position.

3. The spark plug of claim 2, wherein the position of smallest sectional area of the metallic shell orthogonal to the direction of central axis O is a buckling portion of the metallic shell.

4. The spark plug of claim 1, wherein the thickness of the packing is 0.1 mm or more.

5. The spark plug of claim 2, wherein the thickness of the packing is 0.1 mm or more.

* * * * *